US008863735B2

(12) United States Patent
Cadima

(10) Patent No.: US 8,863,735 B2
(45) Date of Patent: Oct. 21, 2014

(54) GAS BURNER ASSEMBLY

(75) Inventor: Paul Bryan Cadima, Prospect, KY (US)

(73) Assignee: General Electric Company, Schenectady, NY (US)

( * ) Notice: Subject to any disclaimer, the term of this patent is extended or adjusted under 35 U.S.C. 154(b) by 280 days.

(21) Appl. No.: 13/414,204

(22) Filed: Mar. 7, 2012

(65) Prior Publication Data

US 2013/0233296 A1 Sep. 12, 2013

(51) Int. Cl.

| | |
|---|---|
| ***F24C 3/00*** | (2006.01) |
| ***F23D 14/06*** | (2006.01) |
| ***F23D 14/26*** | (2006.01) |
| *F23D 14/74* | (2006.01) |

(52) U.S. Cl.

CPC ..... *F23D 14/06* (2013.01); *F23D 14/74* (2013.01); *F23D 14/26* (2013.01)

USPC ..... 126/39 E; 431/285; 431/349; 431/350

(58) Field of Classification Search

CPC ..... F24C 3/085; F24C 3/08126; F23D 2900/14062; F23D 14/06; F23D 14/065; F23D 14/58; F23D 14/74; F23D 14/26; A47J 37/0713

USPC ..... 126/39 E, 39 R; 431/114, 266, 278, 285, 431/349, 350, 354

See application file for complete search history.

(56) References Cited

U.S. PATENT DOCUMENTS

| | | | | |
|---|---|---|---|---|
| 5,133,658 | A | 7/1992 | Le Monnier De Gouville et al. | |
| 5,464,004 | A | 11/1995 | Maughan | |
| 5,800,159 | A | 9/1998 | Maughan et al. | |
| 6,439,882 | B2 * | 8/2002 | Haynes et al. | 431/354 |
| 2010/0051014 | A1 * | 3/2010 | Pryor et al. | 126/39 E |

* cited by examiner

*Primary Examiner* — Kenneth Rinehart
*Assistant Examiner* — Bao D Nguyen
(74) *Attorney, Agent, or Firm* — Global Patent Operation; Douglas D. Zhang

(57) ABSTRACT

A burner body for use in a gas burner assembly and/or a gas cooking appliance is disclosed. The burner body comprises a sidewall and a main gas conduit, the main gas conduit having an inlet and an outlet; a plurality of primary burner ports disposed within the sidewall so as to be in communication with the outlet of the main gas conduit; a simmer flame port disposed within the sidewall in a spaced relation with the primary burner ports for providing a reignition source therefore; a stability chamber disposed within the burner body for channeling fuel to the simmer flame port; and a divider disposed in the stability chamber to reduce susceptibility to flashback.

19 Claims, 7 Drawing Sheets

GAS BURNER ASSEMBLY

BACKGROUND OF THE INVENTION

The subject matter disclosed herein relates to gas appliances, such as gas ranges, and more particularly, to gas burner assemblies for use in such gas appliances.

Atmospheric gas burners are often used as surface units in household gas cooking appliances. A significant factor in the performance of gas burners is their ability to withstand airflow disturbances in the surroundings, such as room drafts, rapid movement of cabinet doors, and rapid oven door manipulation. Manipulation of the oven door is particularly troublesome because rapid openings and closings of the oven door often produce respective under-pressure and over-pressure conditions within the oven cavity. Since the flue, through which combustion products are removed from the oven, is sized to maintain complete combustion of gaseous fuels and is generally inadequate to supply a sufficient air flow for re-equilibration, a large amount of air passes through or around the gas burners. In particular, pressure fluctuations from, for example, cabinet or door openings, cause the structures to expand or contract (e.g., the sheet metal deflects) and this structural movement pumps air into adjacent cavities, causing the temporary under or over pressure conditions. This surge of air around the gas burners, due to over pressure or under pressure conditions in the oven cavity, is detrimental to the flame stability of the burners and may extinguish the flames. This flame stability problem is particularly evident in sealed gas burner arrangements, referring to the lack of an opening in the cooktop surface around the base of the burner to prevent spills from entering the area beneath the cooktop.

A cause of flame instability is the low pressure drop of the fuel/air mixture passing through the burner ports of a typical rangetop burner. Although there is ample pressure available in the fuel, the pressure energy is used to accelerate the fuel to the high injection velocity required for primary air entrainment. Relatively little of this pressure is recovered at the burner ports. A low pressure drop across the ports allows pressure disturbances propagating through the ambient to easily pass through the ports, momentarily drawing or pulling the flame away from the burner ports and leading to thermal quenching and extinction.

An additional problem is that rapid adjustments of the fuel supply to a gas burner from a high burner input rate to a low burner input rate often will cause flame extinction when the momentum of the entrained air flow continues into the burner even though fuel has been cut back, resulting in a momentary drop in the fuel/air ratio, causing extinction.

A number of techniques have been proposed or suggested for improving stability performance. U.S. Pat. No. 5,133,658, for example, employs an expansion chamber to improve flame stability. The disclosed gas burners have a plenum ahead of a number of main burner ports. An expansion chamber inlet is located in the plenum, adjacent the main flame ports. When a pressure disturbance enters the burner (suction, for example, from the opening of an oven door), the pressure drop and flow velocity through the main burner ports are momentarily disrupted causing unwanted extinction of the main burner flames. The expansion chamber flame, however, is less susceptible to extinction due to the damping effect described in earlier art. Although such gas burners having an expansion chamber provide somewhat improved stability performance at simmer settings, disturbances continue to cause unwanted extinction. Furthermore, these expansion chambers have excessively large flames at higher burner input rates.

U.S. Pat. No. 5,800,159 to Maughan et al. (hereinafter, the "'159 Patent") overcomes the issue of excessively large flames using a stability chamber that is insensitive to input rates. The '159 Patent discloses an improved chamber where the inlet ports that feed the stability chamber are located substantially near the Venturi throat such that the volume of gas entering the chamber at higher flow rates is disproportionally low relative to the volume of gas entering the chamber at lower flow rates. Generally, the techniques of the '159 Patent seek to limit the flame length of the stability chamber at higher flow rates when the stability chamber is not needed. However, one inherent weakness of the approach disclosed in the '159 Patent is the need for physically larger inlet ports to the chamber than is traditionally needed with conventional stability chambers in order to get sufficient gas flow into the chamber at low flow rates. Larger ports with lower pressure drops (and thus lower velocities of gas traveling through them) have an increased tendency to flashback. In addition, since the scale of a stability chamber is limited (they cannot be reduced in size below a minimum volume needed to support a single flame without withdrawing too much heat from the flame into the boundary walls, thereby quenching the flame), the effects of the disclosed teachings become exaggerated in smaller burner sizes, making it troublesome to optimize smaller burner designs without the need for even larger chamber inlet port sizes.

A further problem with the approach disclosed in the '159 Patent is realized when burner caps use projections to position themselves concentrically on the burners. Caps made of stamped steel offer cost advantages to alternative caps such as sintered metal or die cast forms. Welding studs to the bottom side gives low cost stamped steel caps a means to be positioned and, if done correctly, will be obvious to the user when assembled onto the burner incorrectly. These projections can often be positioned unintentionally into the chamber since the chamber travels the bulk of the radial length of the burner. When this happens, the cap may be positioned in an undesirable, non-concentric state. Additional projections or studs may be added to a cap to overcome this problem, but this increases the cost of the caps and interference of fuel flow through the burner head.

Thus, there remains a need for an improved atmospheric gas burner that is better able to withstand flashback tendencies. Yet another need exists for stability chambers that can better prevent miss-assembly of caps that use projections to position themselves, while also taking advantage of the teachings of the '159 Patent.

BRIEF DESCRIPTION OF THE INVENTION

As described herein, the exemplary embodiments of the present invention overcome one or more disadvantages known in the art.

One aspect of the present invention relates to an improved burner body for use in a gas burner assembly or a gas cooking appliance (or both). The burner body comprises a sidewall and a main gas conduit, the main gas conduit having an inlet and an outlet; a plurality of primary burner ports disposed within the sidewall so as to be in communication with the outlet of the tubular main gas conduit; a simmer flame port disposed within the sidewall in a spaced relation with the primary burner ports for providing a reignition source therefore; a stability chamber disposed within the burner body, and a divider disposed in the stability chamber to reduce susceptibility to flashback.

Another aspect of the present invention relates to a gas burner assembly for connection to a source of gas. The gas burner assembly comprises a burner body having a sidewall and a main gas conduit having an inlet and an outlet; a plurality of burner ports disposed within the sidewall so as to be in communication with the outlet of the main gas conduit; a simmer flame port disposed within the sidewall in a spaced relation with the primary burner ports for providing a reignition source therefore; a stability chamber disposed within the burner body to channel fuel from the conduit outlet to the simmer flame port; and a divider disposed in the stability chamber.

Advantageously, illustrative embodiments of the present invention provide improved stability chambers with a reduced tendency to flashback and with a reduced likelihood that a user will improperly position a cap on the burner.

These and other aspects and advantages of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. Moreover, the drawings are not necessarily drawn to scale and, unless otherwise indicated, they are merely intended to conceptually illustrate the structures and procedures described herein.

DETAILED DESCRIPTION OF THE EXEMPLARY EMBODIMENTS OF THE INVENTION

One or more illustrative embodiments of the invention will be described below in the context of an oven appliance. However, it is to be understood that embodiments of the invention are not intended to be limited to use with any particular gas appliance. Rather, embodiments of the invention may be applied to and deployed in any other suitable environment in which it would be desirable to relight extinguished flames of adjacent flame ports in a gas burner.

As illustratively used herein, the term "appliance" is intended to refer to a device or equipment designed to perform one or more specific functions. This may include, but is not limited to, equipment for consumer use, e.g., a gas range on a freestanding oven. This may include, but is not limited to, any equipment that is useable in household or commercial environments.

While the methods and apparatus are herein described in the context of a gas-fired cooktop, as set forth more fully below, it is contemplated that the herein described methods and apparatus may find utility in other applications, including, but not limited to, gas heater devices, gas ovens, gas kilns, gas-fired meat smoker devices, and gas barbecues. In addition, the principles and teachings set forth herein may find equal applicability to combustion burners for a variety of combustible fuels. The description below is therefore set forth only by way of illustration rather than limitation, and any intention to limit practice of the herein described methods and apparatus to any particular application is expressly disavowed.

Figure 1:
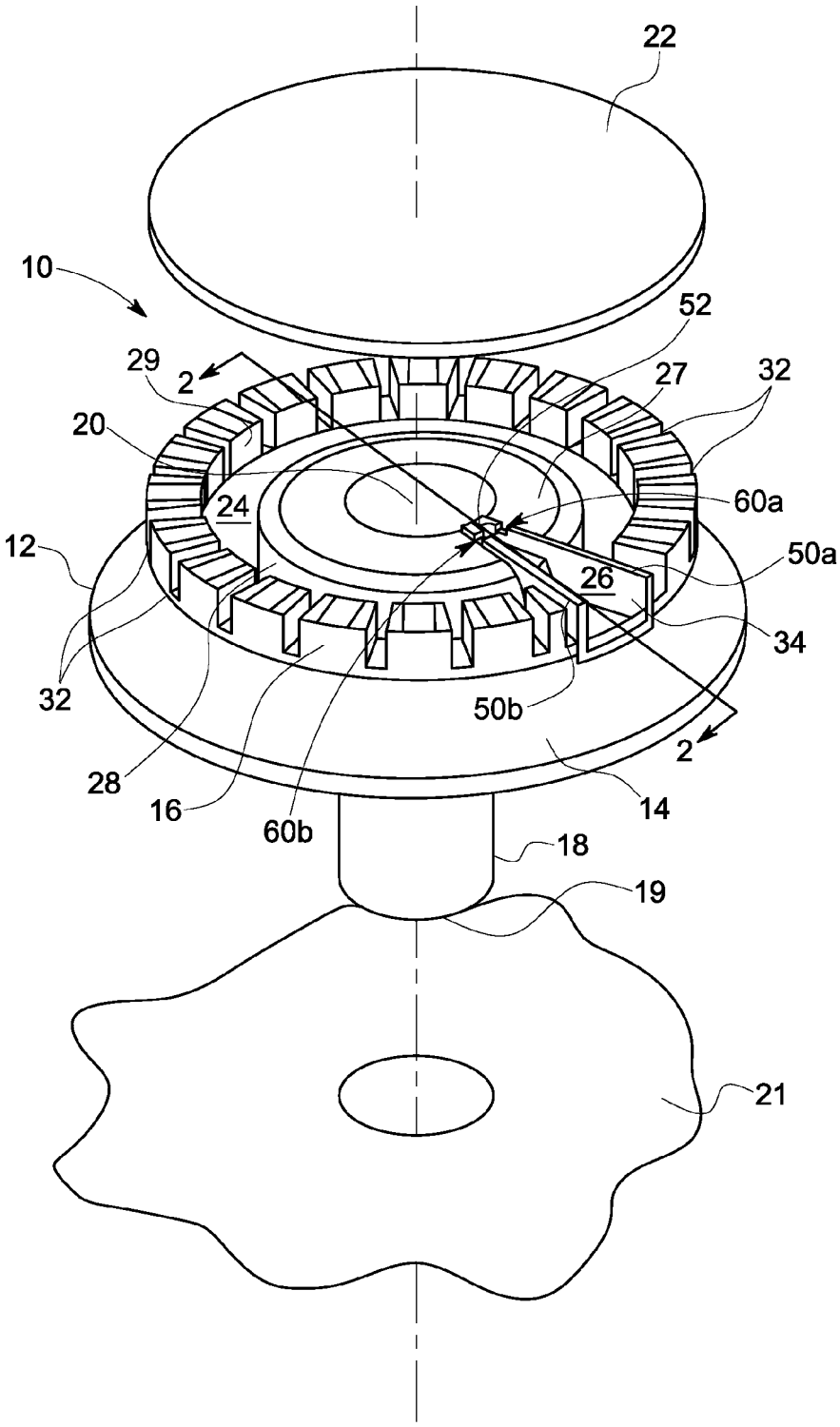
FIG. 1 PRIOR ART
FIG. 1 is an exploded perspective view of a prior art gas burner assembly incorporating a stability chamber to improve stability performance.
Figure 2:
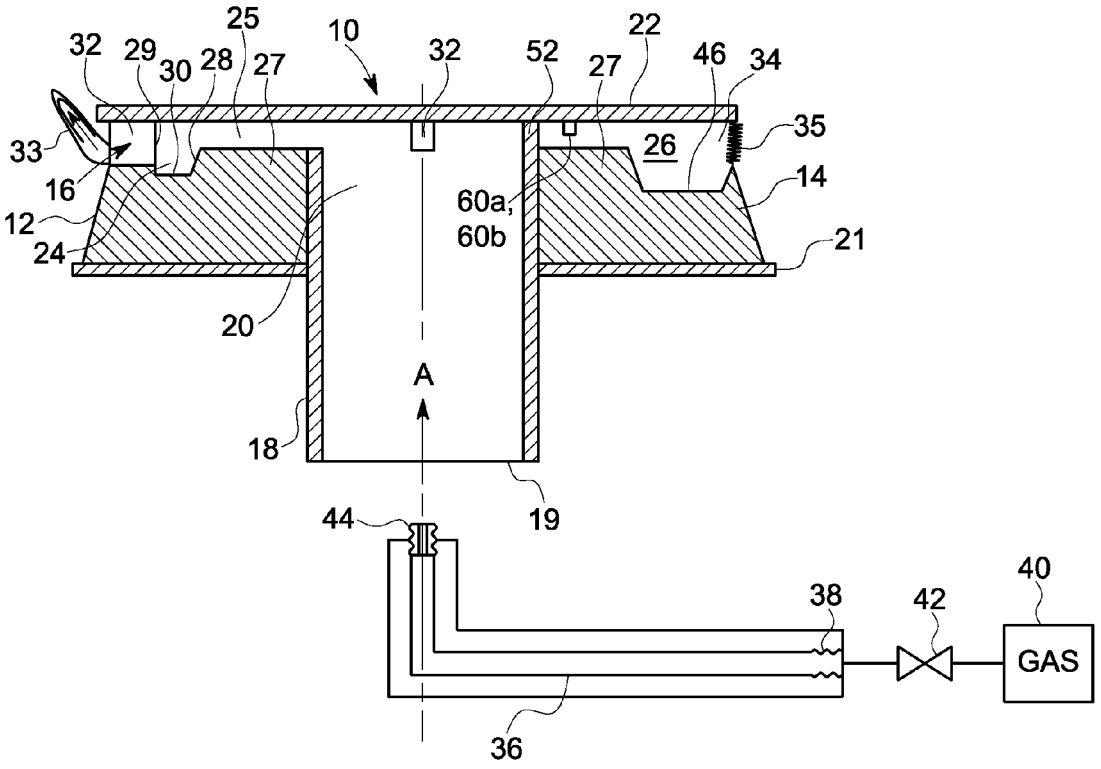
FIG. 2 PRIOR ART
FIG. 2 is a cross-sectional plan view through line 2-2 of FIG. 1.

FIG. 1 is an exploded perspective view of a prior art gas burner assembly 10 incorporating a stability chamber to improve stability performance, and FIG. 2 is a cross-sectional plan view through line 2-2 of FIG. 1. An atmospheric gas burner assembly 10 includes a burner body 12 having a frustum-shaped solid base portion 14 and a cylindrical sidewall 16 extending axially from the periphery of base portion 14, as shown in the illustrative embodiment of FIGS. 1 and 2. A main gas conduit 18 having an inlet 19 and an outlet or burner throat 20 defines a passage which extends axially through the center of burner body 12 to provide fuel/air flow along path "A" (FIG. 2) to burner assembly 10. As used herein, the term "gas" refers to a combustible gas or gaseous fuel mixture.

Burner assembly 10 is attached, in a known manner, to a support surface of a gas cooking appliance such as a range or a cooktop. A cap 22 is disposed over the top of burner body 12, defining therebetween an annular main fuel chamber 24, an annular diffuser region 25 (FIG. 2), and a stability chamber 26, typically wedge-shaped. A toroidal-shaped upper portion 27 of burner body 12, immediately bordering burner throat 20, in combination with cap 22 defines annular diffuser region 25 therebetween. Cap 22 can be fixedly attached to sidewall 16 (FIG. 1) or can simply rest on sidewall 16 for easy removal. While one type of burner is described and illustrated, the instant invention is applicable to other types of burners, such as stamped steel burners and separately mounted orifice burners.

As shown in FIG. 2, annular main fuel chamber 24 is defined by an outer surface 28 of toroidal shaped upper portion 27, an inner surface 29 of sidewall 16, an upper surface 30 of base portion 14, and cap 22. A plurality of primary burner ports 32 are disposed in sidewall 16 (FIG. 1) of burner body 12 so as to provide a path to allow fluid communication with main fuel chamber 24, each primary burner port 32 being adapted to support a respective main flame 33 (FIG. 2). Primary burner ports 32 are typically, although not necessarily, evenly spaced about sidewall 16. As used herein, the term "port" refers to an aperture of any shape from which a flame may be supported.

At least one simmer flame port 34 is disposed in sidewall 16 (FIG. 1) of burner body 12. Stability chamber 26 channels fuel from conduit outlet 20 to simmer flame port 34. Simmer flame port 34 is substantially isolated from main fuel chamber 24 and is adapted to support a simmer flame 35. Simmer flame port 34 is adjacent to primary burner ports 32 to provide a re-ignition source to primary burner ports 32 if flameout occurs. While a single simmer flame port 34 is shown in the drawings, the present invention may include one or more additional simmer flame ports 34. Typically, simmer flame port 34 has an open area five to fifteen times larger than a respective primary burner port 32.

A gas feed conduit 36 (FIG. 2) comprises a coupling 38 disposed on one end for connection to a gas source 40 via a valve 42 (shown schematically in FIG. 2). Valve 42 is controlled in a known manner by a corresponding control knob on the gas cooking appliance to regulate the flow of gas from gas source 40 to gas feed conduit 36. The other end of gas feed conduit 36 is provided with an injection orifice 44. Injection orifice 44 is aligned with main gas conduit 18 so that fuel, discharged from injection orifice 44, and entrained air are supplied to main fuel chamber 24 and stability chamber 26 via main gas conduit 18 along path "A" of FIG. 2.

As shown in FIGS. 1 and 2, stability chamber 26 is substantially isolated from main fuel chamber 24 such that stability chamber 26 is not in immediate fluid communication with main fuel chamber 24 and is therefore relatively independent of primary burner ports 32. Stability chamber 26 is defined on each side by a pair of radially extending baffles 50*a* and 50*b* (FIG. 1), on the bottom by an upper surface 46 (FIG. 2) of base portion 14, and on the top by cap 22. An end wall 52 positioned proximate burner throat 20 further defines stability chamber 26 so as to substantially isolate stability chamber 26 from main fuel chamber 24. In an exemplary embodiment, as best shown in FIG. 2, upper surface 46 of base portion 14 is configured such that stability chamber 26 has a shallow depth at the narrow end of stability chamber 26 closest to burner throat 20 and transitions to a deeper, wider section when closest to simmer flame port 34.

In the embodiment of FIGS. 1 and 2, stability chamber 26 further comprises two stability inlets 60*a* and 60*b*. Stability inlets 60*a*, 60*b* are disposed within respective baffles 50*a*, 50*b* such that stability inlets 60*a*, 60*b* are positioned so as to be substantially symmetrical on each side of stability chamber 26 proximate end wall 52 and correspondingly proximate burner throat 20. Stability inlets 60*a*, 60*b* are substantially perpendicular to the direction of the flow of gas radially outward from burner throat 20 and are tangentially fed the fuel/air mixture by static pressure at that location, as discussed below. This arrangement improves stability performance by permitting an effectively smaller stability chamber inlet to be utilized while retaining sufficient gas flow. Additionally, an aesthetically pleasant reduced stability flame size is created at higher burner input rates. For a more detailed discussion of a prior art gas burner assembly 10 incorporating a stability chamber, see, for example, U.S. Pat. No. 5,800,159, incorporated by reference herein.

Figure 3:
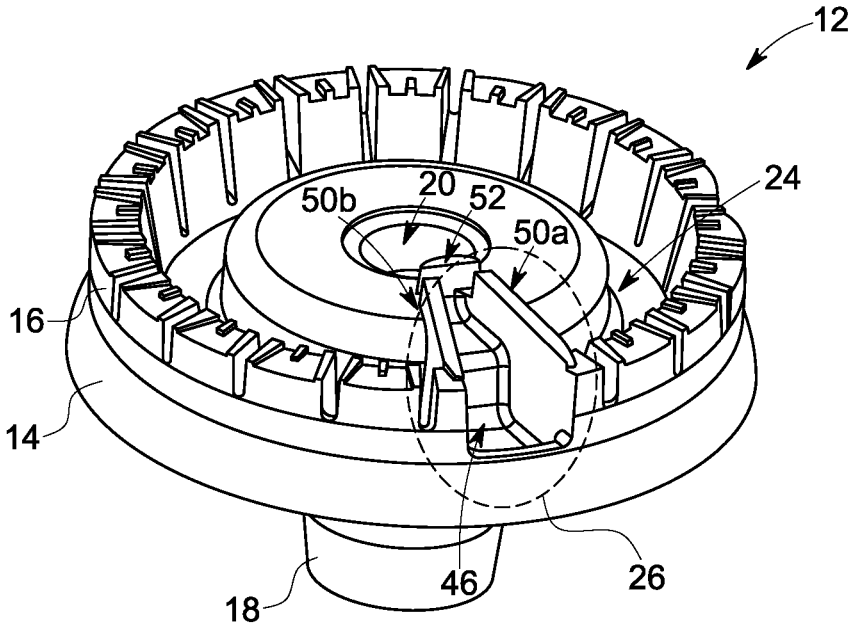
FIG. 3 PRIOR ART
FIG. 3 illustrates the burner body of FIGS. 1 and 2 in further detail.

FIG. 3 illustrates the burner body 12 of FIGS. 1 and 2 in further detail. As shown in FIG. 3, the exemplary burner body 12 comprises a frustum-shaped solid base portion 14 and a cylindrical sidewall 16 extending axially from the periphery of base portion 14. A main gas conduit 18 having a burner throat region which defines an outlet 20 is open to the exterior of burner body 12 and defines a passage which extends axially through the center of burner body 12 to provide fuel/air flow as discussed above in conjunction with FIG. 2.

Figure 4:
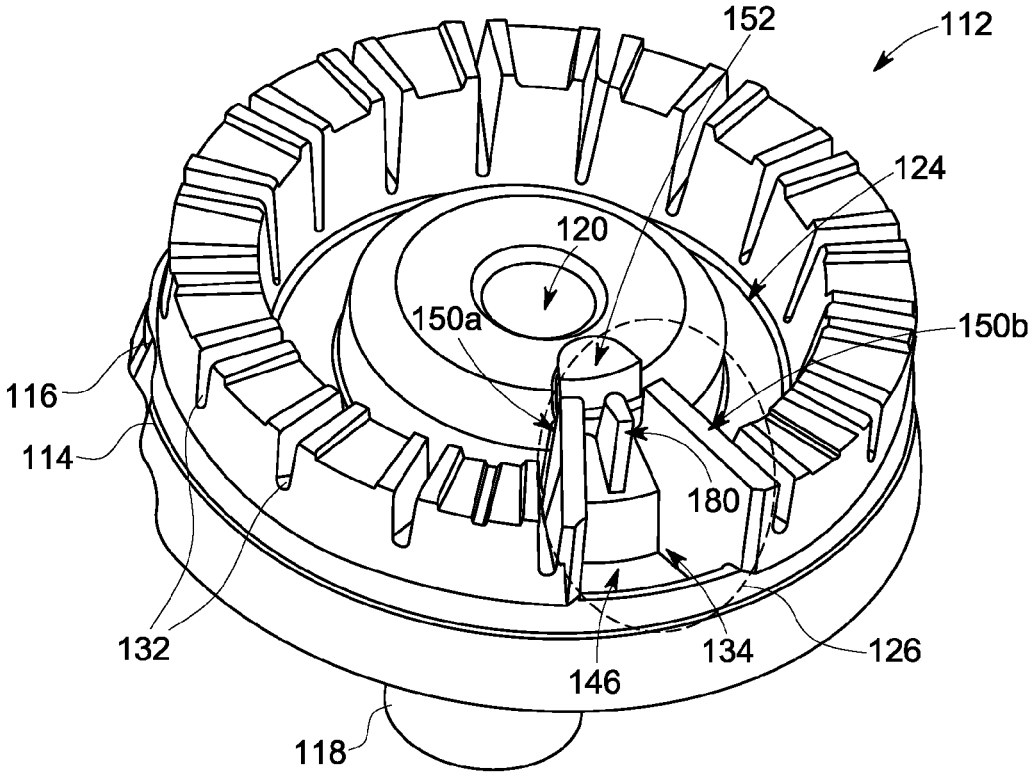
FIG. 4 illustrates a perspective view of an exemplary burner body in accordance with the present invention.
Figure 5:
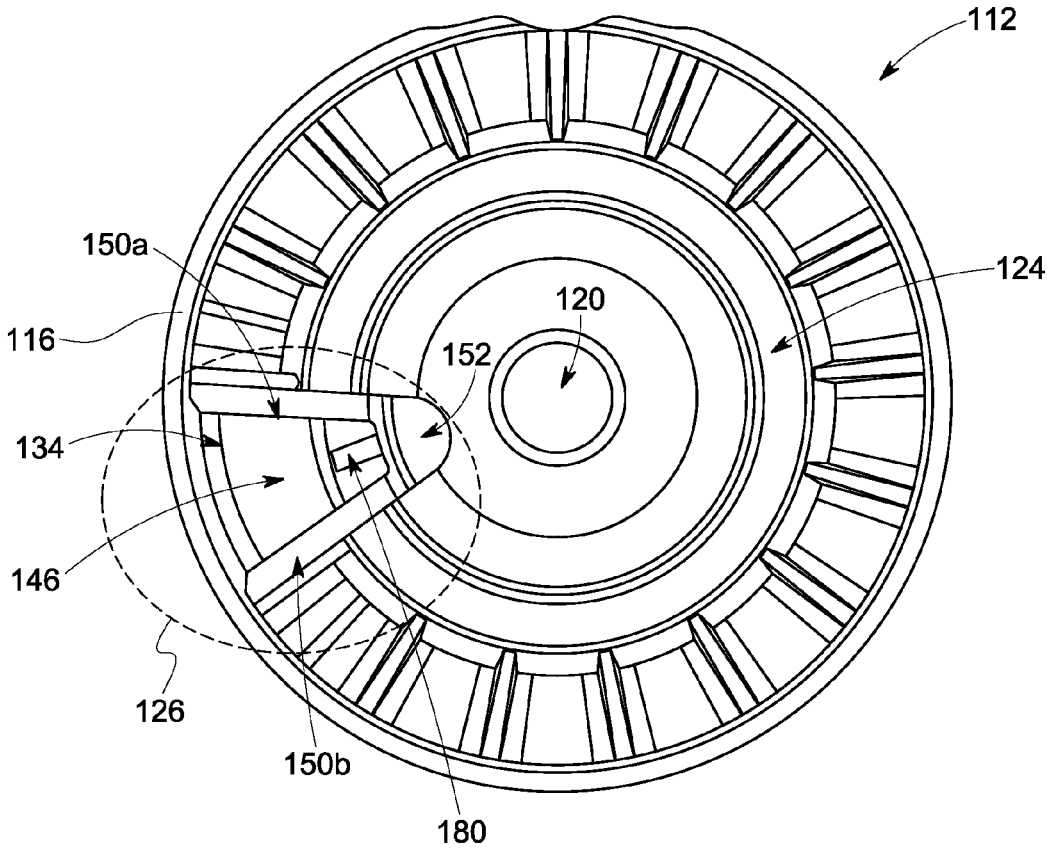
FIG. 5 illustrates a top view of the exemplary burner body of FIG. 4 in accordance with the present invention.

FIG. 4 illustrates a perspective view of an exemplary burner body 112 in accordance with the present invention. FIG. 5 illustrates a top view of the exemplary burner body 112 of FIG. 4 in accordance with the present invention. As shown in FIGS. 4 and 5, the exemplary burner body 112 comprises a frustum-shaped solid base portion 114 and a cylindrical sidewall 116 extending axially from the periphery of base portion 114, in a similar manner to FIG. 3. A main gas conduit 118 having a burner throat region defining an outlet 120 is open to the exterior of burner body 112 and defines a passage which extends axially through the center of burner body 112 to provide fuel/air flow as discussed above in conjunction with FIG. 2.

As shown in FIGS. 4 and 5, a stability chamber 126 provides a channel for fuel for simmer flame port 134 which is substantially isolated from main fuel chamber 124 such that stability chamber 126 is not in immediate fluid communication with main fuel chamber 124 and is therefore relatively independent of primary burner ports 132, in a similar manner to FIG. 3. An expansion region of stability chamber 126 is defined on each side by a pair of radially extending baffles 150*a* and 150*b*, on the bottom by an upper surface 146 of base portion 114, and on the top by a cap (not shown in FIG. 4 or 5). An end wall 152 positioned proximate burner throat 120 further defines stability chamber 126 so as to substantially isolate stability chamber 126 from main fuel chamber 124. As shown in FIG. 4, upper surface 146 of base portion 114 is configured such that stability chamber 126 has a shallow depth at the narrow end of stability chamber 126 closest to outlet 120.

According to one aspect of the present invention, as discussed further below, a divider 180 is disposed in stability chamber 126 to reduce susceptibility to flashback. In addition, as discussed further below, the divider 180 assists with the proper positioning of a burner cap (not shown) on the burner body 112. In the exemplary embodiment shown in FIGS. 4 and 5, the divider 180 is substantially in the center of the stability chamber 126, in the vicinity of the end wall 152. Among other benefits, the divider increases the surface area of the stability chamber 126 and introduces an additional heat transfer member. The gas feeding the simmer flame port 134 must now flow through the left or right chamber created by the divider 180 in the stability chamber 126, thereby limiting the size of any flame extending back into the chamber, improving the resistance to flashback.

Figure 6:
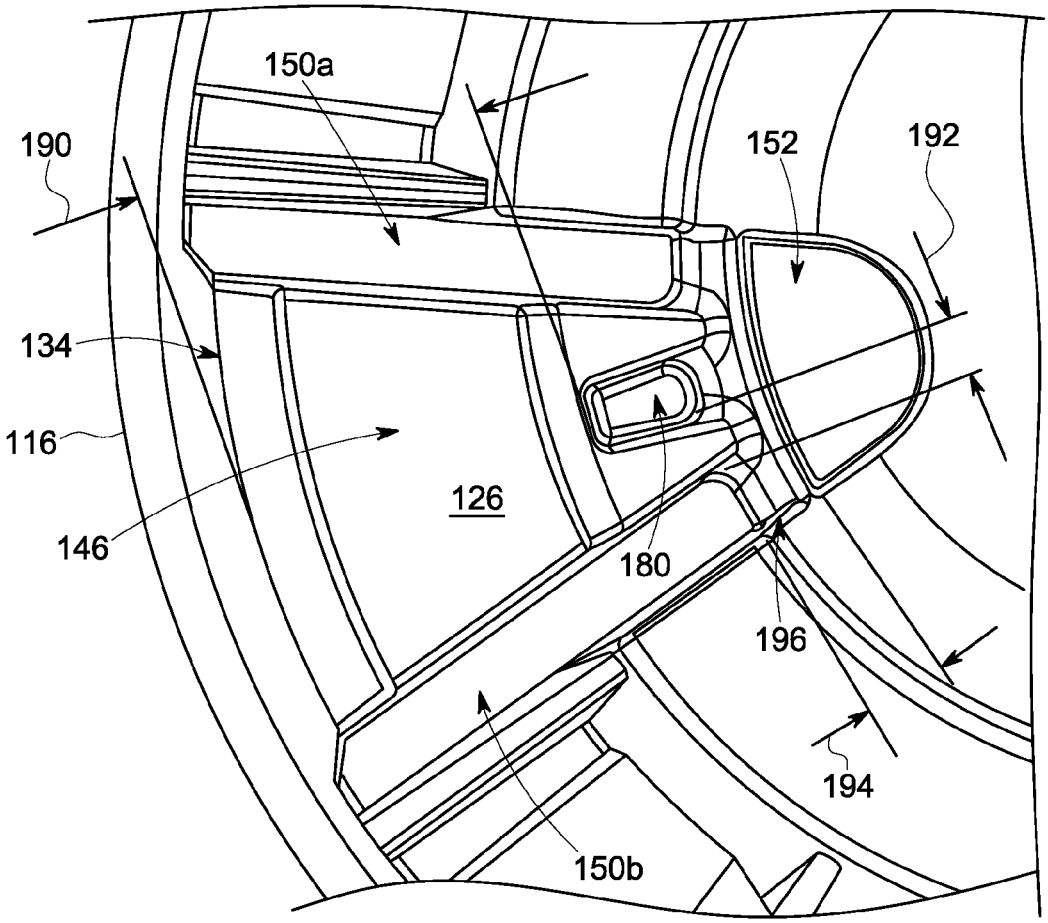
FIG. 6 is a top view of a portion of the exemplary burner body of FIGS. 4 and 5 illustrating an embodiment of the divider of the present invention in further detail.

FIG. 6 is a top view of a portion of the exemplary burner body 112 of FIGS. 4 and 5. In one embodiment, the divider 180 has a length that is less than the length of the chamber 126 such that it does not encroach on the simmer flame from the simmer flame port 134, so as to not interfere with the functionality of the chamber 126. By ensuring the clearances 192 around the divider 180 for gas to flow are similar to the area 194 through the inlet ports 196, flow volume into the chamber 126 is relatively unaffected yet the residence time of the gas along burner walls is effectively increased. Thus, the tendency for flame to burn back through the ports 196 of the chamber 126 into the burner throat 120 is greatly reduced.

In practice, the actual clearances between the divider 180 as well as the length of the divider needed to improve flashback resistance vary, for example, with the operating temperatures of the burner 112, material thermal conductivity and the amount of primary aeration. In one exemplary implementation, shown in FIG. 6, the distance 190 between the divider 180 and the exit of the stability chamber 126 is at least 0.35". In addition, the distance 192 between the divider 180 and each sidewall 150 is approximately equal to the size 194 of the inlet ports 196. In one exemplary embodiment, the size 194 of the inlet ports 196 is approximately 0.075".

Figure 7:
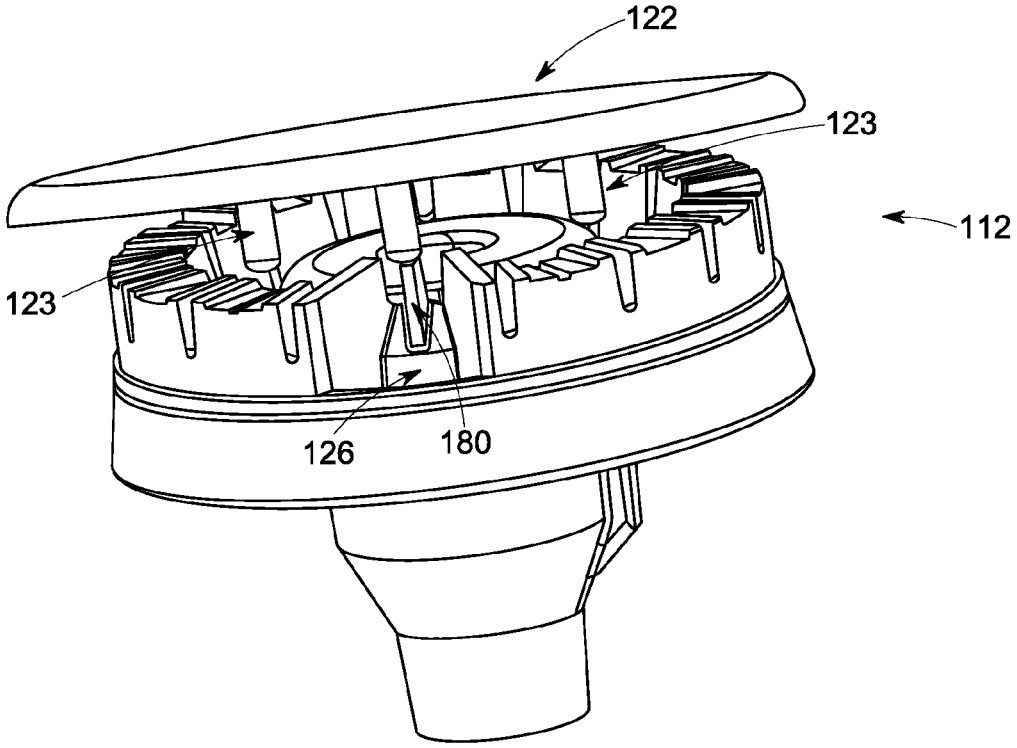
FIG. 7 illustrates a perspective view of an exemplary burner body and burner cap in accordance with the present invention.

FIG. 7 illustrates a perspective view of an exemplary burner body 112 and burner cap 122 in accordance with the present invention. As shown in FIG. 7, the exemplary burner cap 122 includes projections 123, such as studs, to position the cap concentrically on the burner 112. With conventional designs, the projections 123 can often be positioned unintentionally into the stability chamber 126 since the chamber 126 travels the bulk of the radial length of the burner 112. When this happens, the cap may be positioned in an undesirable, non-concentric state. If a projection 123 is improperly positioned over the divider 180 of the present invention, however, it will be readily apparent to the user. In this manner, mispositioning of the cap 122 on the burner 112 is obvious with the divider 180.

Thus, while there have been shown and described and pointed out fundamental novel features of the invention as applied to exemplary embodiments thereof, it will be understood that various omissions and substitutions and changes in the form and details of the devices illustrated, and in their operation, may be made by those skilled in the art without departing from the spirit of the invention. Moreover, it is expressly intended that all combinations of those elements and/or method steps which perform substantially the same function in substantially the same way to achieve the same results are within the scope of the invention. Furthermore, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A burner body for use in a gas burner assembly, said burner body comprising:

a sidewall and a main gas conduit, said main gas conduit having an inlet and an outlet;

a plurality of primary burner ports disposed within said sidewall so as to be in communication with said outlet of said main gas conduit;

a simmer flame port disposed within said sidewall in a spaced relation with said primary burner ports for providing a reignition source therefore; and a stability chamber disposed within said burner body, wherein said stability chamber comprises a divider configured to divide said stability chamber into two or more chambers.

2. The burner body of claim 1, wherein said divider is in a center of said stability chamber.

3. The burner body of claim 1, wherein said divider is in a vicinity of an end wall of said stability chamber.

4. The burner body of claim 1, wherein said divider has a length that is less than a length of said stability chamber.

5. The burner body of claim 1, wherein said divider has a clearance area around said divider for a flow of gas, wherein said clearance area is approximately equal to an area of one or more inlet ports of said stability chamber.

6. The burner body of claim 1, wherein said divider is positioned in said stability chamber to interfere with one or more projections on a burner cap.

7. The burner body of claim 1, wherein said stability chamber comprises a pair of baffles radially extending from an end wall proximate said main gas conduit to said sidewall, said divider extending radially from said end wall towards said sidewall between said pair of baffles.

8. The burner body of claim 7, wherein said stability chamber has a first depth at a first end of said stability chamber proximate said main gas conduit and has a second depth at a second end of said stability chamber proximate said sidewall, wherein said second depth is greater than said first depth.

9. A gas cooking appliance comprising a burner body, said burner body comprising:

a sidewall and a main gas conduit, said main gas conduit having an inlet and an outlet;

a plurality of primary burner ports disposed within said sidewall so as to be in communication with said outlet of said main gas conduit;

a simmer flame port disposed within said sidewall in a spaced relation with said primary burner ports for providing a reignition source therefore; and a stability chamber disposed within said burner body, wherein said stability chamber comprises a divider configured to divide said stability chamber into two or more chambers.

10. The gas cooking appliance of claim 9, wherein said divider is in a center of said stability chamber.

11. The gas cooking appliance of claim 9, wherein said divider is in a vicinity of an end wall of said stability chamber.

12. The gas cooking appliance of claim 9, wherein said divider has a length that is less than a length of said stability chamber.

13. The gas cooking appliance of claim 9, wherein said divider has a clearance area around said divider for a flow of gas, wherein said clearance area is approximately equal to an area of one or more inlet ports of said stability chamber.

14. The gas cooking appliance of claim 9, wherein said divider is positioned in said stability chamber to interfere with one or more projections on a burner cap.

15. A gas burner assembly for connection to a source of gas, said gas burner assembly comprising:

a burner body having a sidewall and a main gas conduit having an inlet and an outlet;

a plurality of burner ports disposed within said sidewall so as to be in communication with said outlet of said main gas conduit;

a simmer flame port disposed within said sidewall in a spaced relation with said primary burner ports for providing a reignition source therefore;

a stability chamber disposed within said burner body to channel fuel from said outlet of said main gas conduit to said simmer flame port; and a divider disposed in said stability chamber, said divider being configured to divide said stability chamber into two or more chambers.

16. The gas burner assembly of claim 15, wherein said divider comprises a radially extending vertical member positioned centrally in said stability chamber.

17. The gas burner assembly of claim 15, wherein said divider comprises a radially extending vertical member, the innermost portion of said divider being proximate said outlet of said main gas conduit.

18. The gas burner assembly of claim 15, wherein said divider comprises a radially extending vertical member having a radial length that is less than a length of said stability chamber.

19. The gas burner assembly of claim 15, further comprising a burner cap supported on a base of the burner body, said burner cap comprising at least one locator projection extending downwardly therefrom and wherein said divider is positioned in said stability chamber so as to prevent said locator projection from being received in said stability chamber.

* * * * *